US010403181B2

(12) United States Patent
Jumblatt et al.

(10) Patent No.: US 10,403,181 B2
(45) Date of Patent: Sep. 3, 2019

(54) COLOR CHANGING DISPLAY SYSTEMS

(71) Applicant: JUMBIE, LLC, Louisville, KY (US)

(72) Inventors: Nicholas Jumblatt, Louisville, KY (US); Eric Francke, Louisville, KY (US)

(73) Assignee: JUMBIE, LLC, Louisville, KY (US)

( * ) Notice: Subject to any disclaimer, the term of this patent is extended or adjusted under 35 U.S.C. 154(b) by 0 days.

(21) Appl. No.: 16/040,947

(22) Filed: Jul. 20, 2018

(65) Prior Publication Data

US 2018/0330645 A1 Nov. 15, 2018

Related U.S. Application Data

(63) Continuation of application No. 14/747,581, filed on Jun. 23, 2015, now Pat. No. 10,032,395, which is a continuation-in-part of application No. 13/169,648, filed on Jun. 27, 2011, now Pat. No. 9,064,433.

(60) Provisional application No. 61/358,747, filed on Jun. 25, 2010.

(51) Int. Cl.

| | |
|---|---|
| ***G09F 13/18*** | (2006.01) |
| ***G09F 19/20*** | (2006.01) |
| ***B65D 23/12*** | (2006.01) |
| *G09F 13/22* | (2006.01) |
| *B65D 23/08* | (2006.01) |

(52) U.S. Cl.

CPC ..... *G09F 13/18* (2013.01); *B65D 23/12* (2013.01); *G09F 19/20* (2013.01); *G09F 19/205* (2013.01); *B65D 23/0842* (2013.01); *B65D 2203/12* (2013.01); *G09F 2013/222* (2013.01)

(58) Field of Classification Search

CPC ..... G09F 13/18; G09F 19/20; B65D 2203/02
USPC ..... 40/564, 581
See application file for complete search history.

(56) References Cited

U.S. PATENT DOCUMENTS

| | | | | |
|---|---|---|---|---|
| 6,417,779 | B1 * | 7/2002 | Noll | B60Q 3/14 340/815.45 |
| 6,862,824 | B1 * | 3/2005 | Hermanson | G09F 19/12 40/414 |
| 7,581,342 | B2 * | 9/2009 | Egami | G09F 13/22 340/815.44 |
| 7,658,519 | B2 * | 2/2010 | Mita | G09F 13/04 362/23.01 |

(Continued)

*Primary Examiner* — Joanne Silbermann
(74) *Attorney, Agent, or Firm* — Stites & Harbison, PLLC; Jeffrey A. Haeberlin; James R. Hayne

(57) ABSTRACT

A color changing display system includes a docking member, a light source secured to the docking member, a controller electrically connected to the light source, a body removably connected to the docking member, and a combined printed image comprising two or more images printed in a single layer on the body. The light source is for producing different light colors. The controller is configured to control the light source to provide a smooth transition between the different light colors. The images are different colors. Each of the different color images reacts with a respective color of the different light colors such that an appearance of the combined printed image changes gradually from a first display image having one particular shape into a second display image having a second particular shape in response to the different light colors interacting with the combined printed image to produce a moving, seemingly holographic effect.

15 Claims, 11 Drawing Sheets

(56) References Cited

U.S. PATENT DOCUMENTS

| | | | | |
|---|---|---|---|---|
| 7,685,753 | B2 * | 3/2010 | Slowski | G09F 13/04 40/550 |
| 9,064,433 | B2 * | 6/2015 | Jumblatt | B65D 1/02 |
| 9,648,672 | B2 * | 5/2017 | Chien | H05B 33/08 |
| 10,032,395 | B2 * | 7/2018 | Jumblatt | G09F 19/205 |
| 2008/0236006 | A1 * | 10/2008 | Chadwell | G09F 13/04 40/581 |
| 2017/0167674 | A1 * | 6/2017 | Frycz | F21S 8/035 |

* cited by examiner

COLOR CHANGING DISPLAY SYSTEMS

RELATED APPLICATIONS

This application is a continuation of prior application Ser. No. 14/747,581, filed Jun. 23, 2015, which was a continuation-in-part of prior application Ser. No. 13/169,648, filed Jun. 27, 2011, which claimed the benefit of U.S. Provisional Application No. 61/358,747, filed Jun. 25, 2010, the entire disclosures of which are incorporated herein by this reference.

TECHNICAL FIELD

The presently-disclosed subject matter relates to color changing displays and systems thereof. In particular, the presently-disclosed subject matter relates to color changing displays that incorporate one or more lights to produce a color changing illumination and change the appearance of a combined image.

BACKGROUND

Individuals are increasingly being confronted with attention-getting displays and gimmicks that are put forth by various companies trying to sell their goods and services. Indeed, in recent years, the advertising industry has strived to not only make advertisements and displays bigger and brighter, but also flashier, more elaborate, and more interactive. However, these attempts by the advertising industry to make advertisements and displays "bigger and better" have led to a number of logistical and financial problems.

For example, some in the advertising industry have focused their efforts on constructing large interactive displays that include brightly-illuminated, high-definition screens. These displays are large enough to grab the attention of many individuals and are versatile in the sense that they can be used to display a number of different advertisements. However, these types of displays are often difficult to construct and are expensive to manufacture, operate, and maintain.

In this regard, others in the advertising industry have constructed displays that consist of large static or mechanical signage. While these later types of displays do not provide the versatility that is seen with high-definition screens, the static or mechanical displays are still effectively used as an advertising means as the displays are often well lit with white high-intensity discharge lighting. Inevitably, however, the use of high-intensity discharge lighting has made it expensive to provide these types of displays with sufficient electricity. As such, individuals in the adverting industry have now begun to use energy efficient light-emitting diodes (LEDs) as LEDs have a high lumen output and a distinctly low power consumption. Some advertisers have even begun to utilize colored LEDs, such as red-green-blue LEDs (RGB-LEDs), to incorporate various colors into a display.

To date, however, an advertisement or display has yet to be manufactured in which LEDs are effectively used as a secondary part of the display to project light onto an image and create a brighter and more interactive image in a display or advertisement. Instead, LEDs have merely been utilized as primary part of a display itself, either to light a fixed image or as a light in the display itself.

SUMMARY

The presently-disclosed subject matter relates to a color changing display system that incorporates one or more lights to produce a color changing illumination and change the appearance of a combined image.

In accordance with one aspect of the invention, a color changing display system includes a docking member, a light source secured to the docking member, a controller electrically connected to the light source, a body removably connected to the docking member, and a combined printed image comprising two or more images printed in a single layer on the body. The light source is for producing different light colors. The controller is configured to control the light source to provide a smooth transition between the different light colors. The images are different colors. Each of the different color images reacts with a respective color of the different light colors such that an appearance of the combined printed image changes gradually from a first display image having one particular shape into a second display image having a second particular shape in response to the different light colors interacting with the combined printed image to produce a moving, seemingly holographic effect.

In one implementation, the color changing display system further includes a switch electrically connected to the light source. When the body is connected to the docking member, the switch is activated.

In another implementation, the docking member defines a cavity, and the body is partially contained within the cavity when the body is connected to the docking member. This implementation may further include a switch positioned within the cavity of the docking member, the switch electrically connected to the light source such that when the body is connected to the docking member, the switch is activated.

In yet another implementation, the combined printed image is printed on an exterior surface of the body.

In still yet another implementation, the body includes a light-transmitting material, and the light source projects the different light colors onto the body such that the different light colors are transmitted through the light-transmitting material of the body and the combined printed image is back-lit. A portion of the light-transmitting material of the body may be configured for diffuse transmission of the different light colors, and the combined printed image may be printed atop the portion of the light-transmitting material of the body configured for diffuse transmission, such that the different light colors are transmitted evenly through the portion of the light-transmitting material configured for diffuse transmission to evenly back-light the combined printed image.

In another important implementation, the body is a bottle. In one alternative, the bottle may further include a removable label configured for diffuse transmission of the different light colors, and the combined printed image may be printed on the label, such that the light source projects the different light colors through the bottle and the different light colors are transmitted evenly through the label to evenly back-light the combined printed image. In another alternative, the bottle may include a light-transmitting material, and the light source may project the different light colors onto the bottle such that the different light colors are transmitted through the light-transmitting material of the bottle and the combined printed image is back-lit. In yet another alternative, the bottle may be at least partially filled with a light-transmitting fluid, and the light source may project the different light colors onto the bottle such that the different light colors are transmitted through the light-transmitting fluid in the bottle and the combined printed image is back-lit.

In another embodiment, the body defines a compartment and the light source extends away from the docking member such that, when the body is connected to the docking member, the light source is positioned within the compartment of the body.

In accordance with another aspect of the invention, a color changing display system includes a docking member, a light source secured to the docking member, a controller electrically connected to the light source, a bottle removably connected to the docking member, the bottle including a removable label, and a combined printed image comprising two or more images printed in a single layer on the label of the bottle. The light source is for producing different light colors. The controller is configured to control the light source to provide a smooth transition between the different light colors. The images are different colors, each of the different color images reacting with a respective color of the different light colors such that an appearance of the combined printed image changes gradually from a first display image having one particular shape into a second display image having a second particular shape in response to the different light colors interacting with the combined printed image to produce a moving, seemingly holographic effect.

In one implementation, the color changing display system further includes a switch electrically connected to the light source, such that when the bottle is connected to the docking member, the switch is activated.

In another implementation, the docking member defines a cavity, and the bottle is partially contained within the cavity when the bottle is connected to the docking member.

In accordance with another aspect of the invention, a color changing display system includes a fabric body, a light source connected to the fabric body, a controller electrically connected to the light source, and a combined printed image comprising two or more images printed in a single layer on the fabric body. The light source is for producing different light colors. The controller is configured to control the light source to provide a smooth transition between the different light colors. The images are different colors, each of the different color images reacting with a respective color of the different light colors such that an appearance of the combined printed image changes gradually from a first display image having one particular shape into a second display image having a second particular shape in response to the different light colors interacting with the combined printed image to produce a moving, seemingly holographic effect.

In one implementation, the combined printed image is digitally printed on the fabric body.

In another implementation, the combined printed image is sub-dye laminated on the fabric body.

In yet another implementation, the light source projects light through the fabric body.

In still yet another implementation, the fabric body is included as at least a part of a consumer good selected from the group consisting of a shirt, a hat, a backpack, a shoe, a blanket, or a curtain.

Further features and advantages of the present invention will become evident to those of ordinary skill in the art after a study of the description, figures, and non-limiting examples in this document.

DESCRIPTION OF EXEMPLARY EMBODIMENTS

The presently-disclosed subject matter relates to color changing display systems. In particular, the presently-disclosed subject matter relates to color changing display systems that incorporate a light source to produce a color changing illumination and change the appearance of a combined image.

Figure 1:
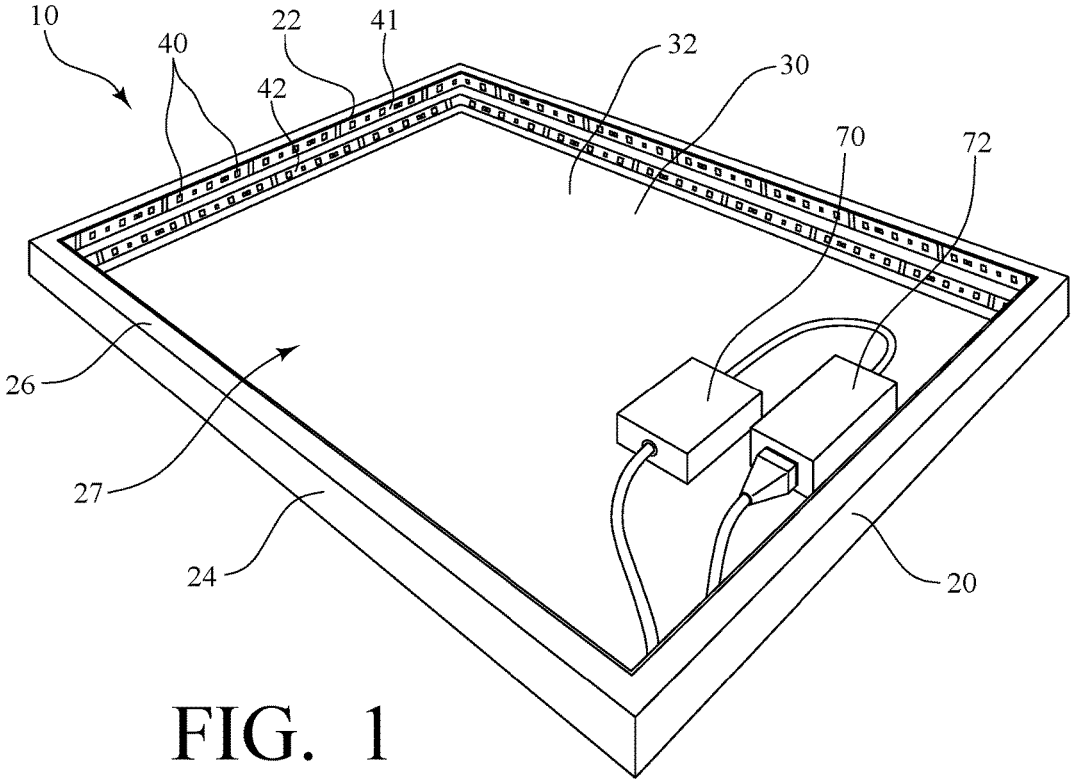
FIG. 1 is a perspective view of an exemplary embodiment of a color changing display system in accordance with the presently-disclosed subject matter, but without a light-transmitting substrate affixed to a front edge of the frame structure.
Figure 2:
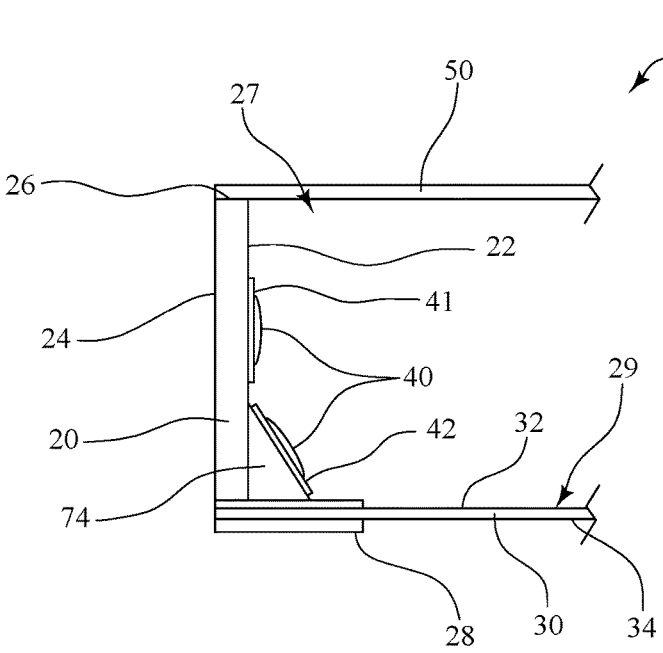
FIG. 2 is a partial cross-sectional view of the color changing display system of FIG. 1, illustrating lights secured to a mounting lip and inner surface of the frame structure and further illustrating a light-transmitting substrate affixed to the front edge of the frame structure.

Referring first to FIGS. 1 and 2, in one exemplary embodiment of a color changing display system 10 made in accordance with the present invention, the color changing display system 10 includes a frame structure 20 that can be fabricated from a variety of materials including wood, plastic, and/or metal. The frame structure 20 includes an inner surface 22, an outer surface 24, a front edge 26 defining an open front portion 27 of the frame structure 20, and a back edge 28 defining an open back portion 29 of the frame structure 20. The color changing display system 10 further includes a panel 30 having a front surface 32 and a back surface 34. The panel 30 is attached to the back edge 28 of the frame structure 20 such that the panel 30 covers the open back portion 29 of the frame structure 20. Typically, the panel 30 and, in particular the front surface 32 of the panel 30, is comprised of a material that is light in color, or that can readily be painted with a light color, such that any light being emitted within the color changing display system 10 is reflected by the panel 30, as described in further detail below.

The color changing display system 10 also includes a light source 40 for producing different light colors. The light source 40 can include one light, or as shown in FIGS. 1 and 2 multiple lights arranged in any position relative to each other. For example, in FIG. 1 multiple lights are secured to the inner surface 22 of the frame structure 20, the front surface 32 of the panel 30, or both. It is contemplated that the lights could be in any of a number of positions. Each light can produce either a single color light or a plurality of color lights such that the light source (i.e., all of the lights taken collectively) produce the different light colors.

The light source 40 is used to produce a color changing illumination that can be directed toward a body 50, shown here in the form of a light-transmitting substrate 50. As shown in FIG. 2, the light-transmitting substrate 50 is attached to the front edge 26 of the frame structure 20 such that the light-transmitting substrate 50 covers the open front portion 27 of the frame structure 20. A variety of materials can be used as a light-transmitting substrate 50 in accordance with the presently-disclosed subject matter including, but not limited to, paper, glass, translucent vinyl, lenticular substrates, or plexiglass. In some embodiments, the light-transmitting substrate 50 is a substrate that is configured for diffuse transmission such that light being emitted from the light source 40 is spread and scattered throughout the surface of the light-transmitting substrate 50 and is thus transmitted evenly through the light-transmitting substrate 50.

As shown in FIG. 1, the color changing display system 10 further includes a controller 70 and a power supply 72, both of which are secured to the front surface 32 of the panel. In this regard, the controller 70 can be operably connected to the light source 40 and used to control the amount and the color of the light that is being emitted from the light source 40. Of course, the power supply 72 is connected to the controller 70 and is used to provide power to the light source 40 and the controller 70. As would be recognized by those of ordinary skill in the art, any suitable power supply can be used in accordance with the presently-disclosed subject matter including, but not limited to, battery packs, AC/DC adapters, and the like. In some embodiments, the controller 70 and power supply 72 are housed in a compartment (not shown) of the frame structure 20 such that the compartment can slide outward and downward to allow an individual to view, access, and manipulate the controller 70, the power supply 72, and any other component of the color changing display system 10.

Figure 3A:
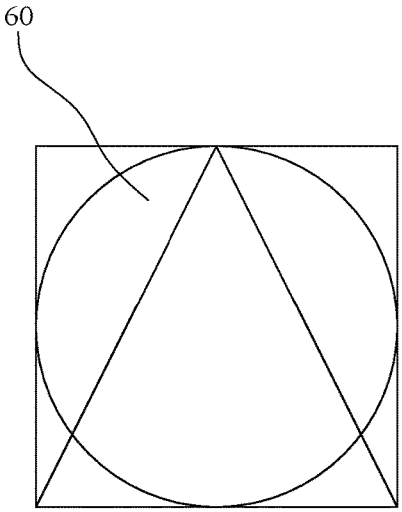
FIGS. 3A-3D include schematic representations of an exemplary combined image that can be affixed to a light-transmitting substrate in accordance with the presently-disclosed subject matter, including a schematic representation of the image exposed to white light (FIG. 3A), a schematic representation of the image under red light (FIG. 3B), a schematic representation of the image under green light (FIG. 3C), and a schematic representation of the image under blue light (FIG. 3D).
Figure 6:
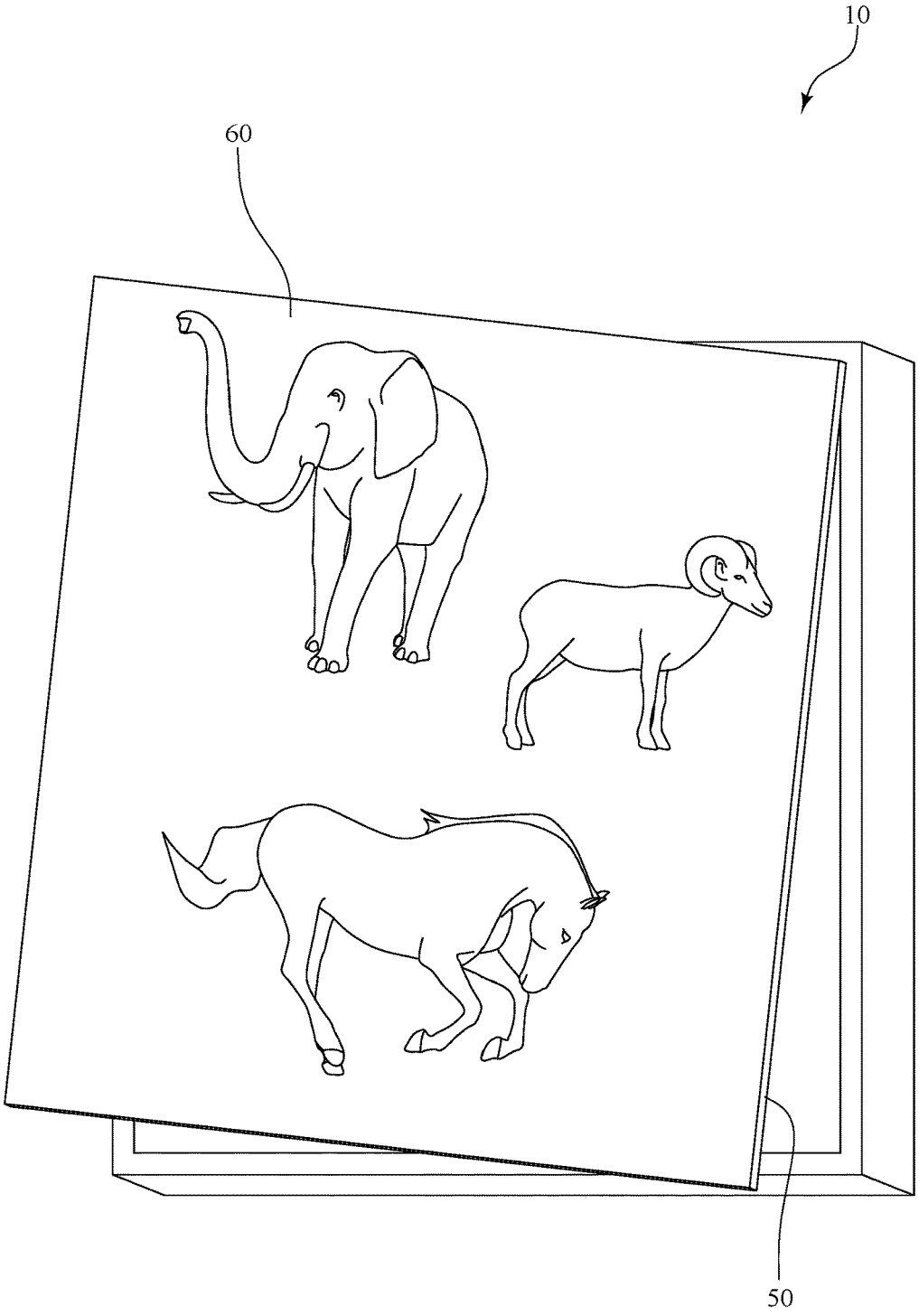
FIG. 6 is a perspective view of another exemplary combined image affixed to a light-transmitting substrate.

As shown in FIGS. 3A and 6, the color changing display system 10 further includes a combined image 60 that is comprised of two or more images and is affixed to the light-transmitting substrate 50. In some embodiments, the combined image 60 can be created and affixed to the light-transmitting substrate by first creating two or more digital images using various digital photo-editing and/or three-dimensional computer software programs (e.g., ADOBE PHOTOSHOP® or AUTODESK® MAYA®). In this regard, the images that are created can be images that are obtained from various media, including drawings, paintings, or photos, and can be made to include assorted colors with varying opacities. Furthermore, by using various digital photo-editing and/or three-dimensional computer software programs, the images can further be made to have assorted textures that are apparent upon printing the images.

As one exemplary method for producing a combined image 60 that can be used in accordance with the presently-disclosed subject matter, in some embodiments, an artist can utilize various brushes and graphic design tools, available on computer software, to produce layered effects. In this regard, the artist can shade and saturate objects with color to form various stylized, digital images that include contrasting colored layers, but yet are still high-definition images that are clear at high resolutions such that the layers appear three-dimensional. Furthermore, in producing the combined image 60, the artist can also cause different layers of the images to have different opacities such that seemingly translucent layers can be created in the images with multiple pigments overlaying one another. Using such techniques, the digital image can achieve the appearance of multiple visible layers on any desired surface upon subsequent printing. Of course, when the digital image is complete, it can also be formatted and flattened such that it can be printed as a single layer.

Regardless of the particular images that are created and/or selected, however, once the images are created and/or selected, the images are then printed. In some embodiments, the combined image 60 is printed using RGB (red, green, blue) printing, as opposed to CMYK (cyan, magenta, yellow, black) printing, to provide a broader spectrum of colors that are capable of reacting with the light being emitted from the lights 40 such that the appearance of the combined image 60 changes in response to different colors of light, as discussed in further detail below. In some embodiments, an ultra-violet (UV) coating can subsequently be applied to the printed image to create a glossy finish that causes the combined image 60 to appear to glow when it is illuminated by the light source 40.

Once the combined image 60 is printed, it is then mounted, framed, or otherwise affixed on top of the light-transmitting substrate 50. In some embodiments, which make use of a digitally photo-developed transparency as the printing material for the combined image 60, the transparency can be affixed to the light-transmitting substrate and then an exterior protective panel (not shown) made of glass, plexiglass, or a like material can be used to cover the combined image 60. In another embodiment wherein the frame structure is comprised of a plastic material, the light transmitting substrate 50 can further include a thin, clear plastic sleeve into which the combined image 60 is easily inserted and removed such that the combined image 60 can readily be changed as desired.

As noted above, the light source 40 of the color changing display system 10 is used to produce a color changing illumination that is directed toward the light-transmitting substrate 50. In this regard, when the combined image 60 is affixed to the light-transmitting substrate 50 and various colors of light are projected onto the light-transmitting substrate 50 and the combined image 60, the various colors of light (e.g., red, green, and blue) react with the layers of the combined image 60 and produce a moving, holographic effect. In some embodiments, when light is projected onto the light-transmitting substrate 50 and the combined image 60 and then transitions from color to color, the transition of light creates a visual effect because the pigment colors are either reflecting or absorbing the different colors of light. For example, in an exemplary combined image 60, an area of green pigment in the combined image 60 will reflect green light, and will absorb light from the red and blue end of the color spectrum. As such, when the light being produced by the light source 40 is a pure green light, the green area of pigment will be visible. However, when the light being emitted by the light source 40 is from the pure blue and pure red ends of the spectrum, the green pigmented area will appear as black or otherwise seem to disappear from the combined image 60. Using this transition of light, the combined image 60 of the color changing display system 10 can thus be made to appear to have movement, depth, and animation, even though the combined image 60 is printed on a flat, static surface.

Figure 3B:
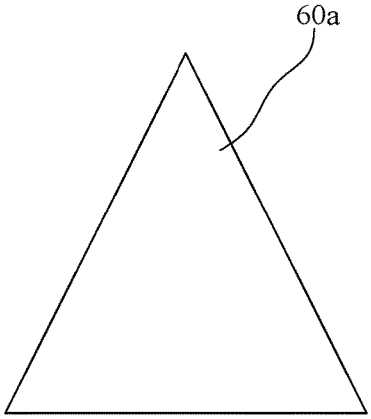
Figure 3C:
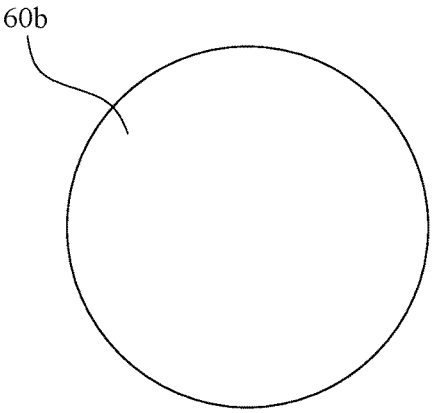
Figure 3D:
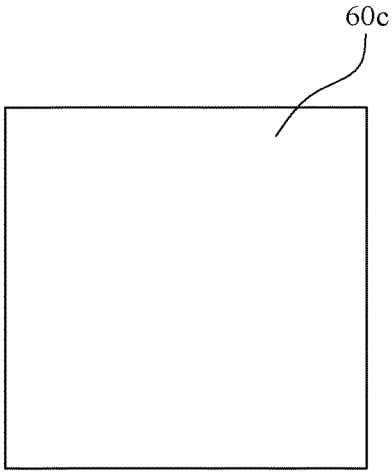

Referring now to FIGS. 3A-3D, as an example of how the presently-disclosed color changing display system 10 can be utilized to seemingly create movement, depth, and animation on a flat, static surface, a combined image 60 can first be digitally created and printed such that the combined image 60 includes three layered (i.e., overlapping) shapes of different colors, namely a red triangle 60*a*, a green circle 60*b*, and a blue square 60*c*. When this image is subsequently illuminated by a white light, all three shapes are visible in their respective colors with some sections of the shapes being partially or entirely covered by one or more of the other shapes, as shown in FIG. 3A, because the combined image is exposed to a full-spectrum of light, allowing each of the colors of the respective shapes to be reflected and perceived. However, when the color of the light being emitted from the light source 40 is changed such that only red light is being emitted, only the red triangle 60*a* will appear visible as the red triangle 60*a* is reflecting red light and the green circle 60*b* and blue square 60*c* are absorbing the red light, as shown in FIG. 3B. Similarly, as shown in FIGS. 3C and 3D, when the color of emitted light is changed such that only green light or blue light is being emitted, only the respective green circle 60*b* or blue square 60*c* will be visible. In this regard, the color of the light being emitted from the light source 40 can be transitioned from color to color to allow the shapes to appear and disappear and, consequently, create a combined image 60 that appears to have depth, movement, and/or animation. Of course, the exemplary application described above is only representative of one possible application of the presently-disclosed color changing display system 10. As would be recognized by those of ordinary skill in the art, the above-described techniques can readily be utilized with a variety of layered images, shapes, and color schemes to create a multitude of seemingly holographic and/or animated images, such as the exemplary combined image 60 shown in FIG. 6 that may include a red elephant, a green horse, and a blue pig. Additionally, the technique described above can further be utilized with a combined image that includes text such that the technique can be used to make certain text appear, disappear, and/or reappear depending on the pigment color used to produce the text and the color of the light being emitted from the light source 40.

With further regard to the light source 40 of the color changing display, and referring again to FIGS. 1 and 2, one or more of the lights of the light source 40 are typically mounted at an angle in the color changing display system 10 such that some of the light being emitted is directed toward a desired portion (e.g., the middle) of the light-transmitting substrate 50. Applicants have discovered that by positioning the lights of the light source 40 in the color changing display system 10 at such an angle, it is possible to avoid the combined image 60 having a center portion that appears darker than the surrounding portions of the combined image 60, such as what may otherwise occur if the lights are flatly mounted on only the inner surface 22 of the frame structure 20.

In some embodiments, to achieve the desired angle of light, a mounting lip 74 is further included in the color changing display system 10 and is secured around the inner surface 22 of the frame structure 20 and the front surface 32 of the panel 30 such that the mounting lip 74 secures the one or more lights 40 at the desired angle. In some embodiments, the mounting lip 74 can be comprised of a piece of quarter-round molding that is installed in the color changing display system 10 such that the emitted light contacts the light-transmitting substrate 50 and the combined image 60 at an angle of about 60° to about 70°. Of course, the materials used to create the mounting lip 74, as well as the desired angle at which the light contacts the light-transmitting substrate 50 and the combined image 60, can readily be changed for a particular combined image 60 or for a particular application without departing from the spirit and scope of the subject matter described herein.

Figure 4:
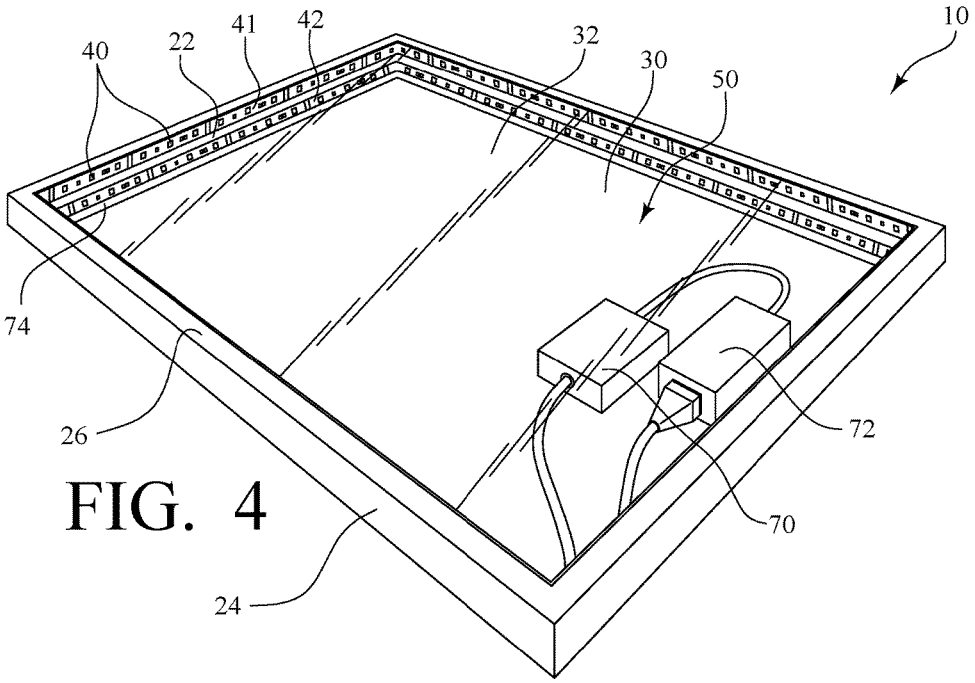
FIG. 4 is a perspective view of an exemplary embodiment of a color changing display system in accordance with the present invention, but without a combined image affixed to the light-transmitting substrate.
Figure 5:
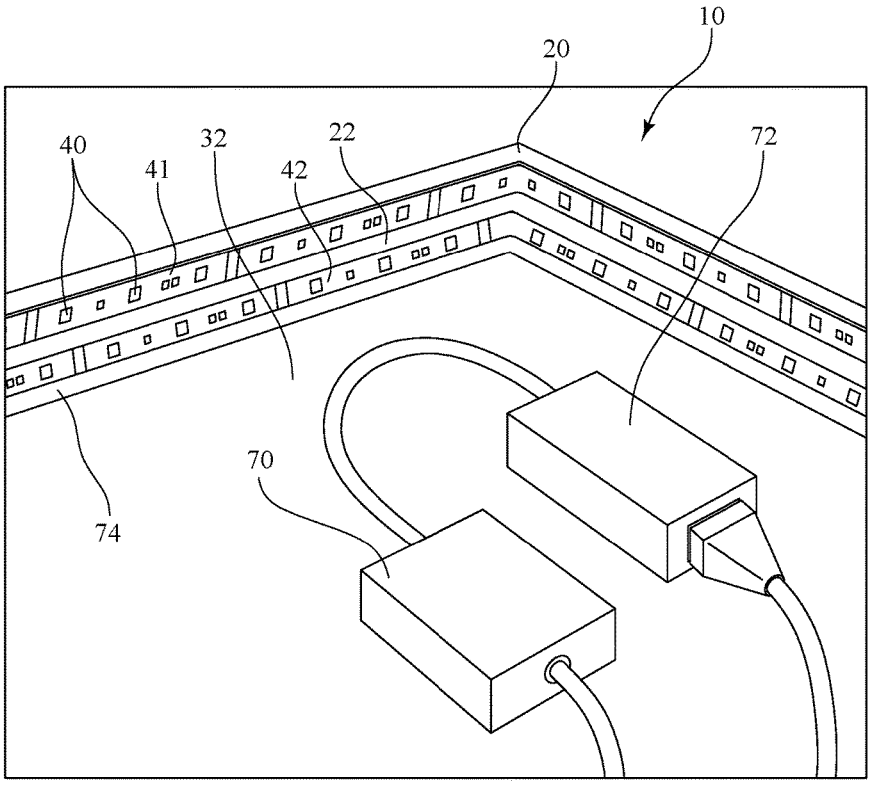
FIG. 5 is a detailed view of a portion of the exemplary color changing display shown in FIG. 4, showing a controller and a power source secured to the front surface of the panel of the color changing display.

With further regard to the light source 40 of the color changing display, and referring now to FIGS. 4 and 5, in some embodiments, the light source 40 includes a red-green-blue light-emitting diode (RGB-LED), which is comprised of one red, one blue, and one green diode. By using the RGB-LEDs in the color changing display system 10, it has been found that the light being emitted from the RGB-LEDs can effectively be used to smoothly transition the light emitted from the light source 40 between the pure colors of the full-spectrum of light, and thus create an appearance that the combined image 60 is fading from one image to the next. Specifically, it has been found that by varying the voltage to each colored diode of the RGB-LED, the voltage to one colored diode can be decreased, while the voltage of the next diode is increased proportionally to thereby provide a smooth transition between colors.

In some embodiments, the RGB-LEDs are arranged in strips of RGB-LEDs 41, 42, as shown in FIGS. 4 and 5. In some embodiments, these strips of RGB-LEDs 41, 42 are further arranged in two rows around the inner surface 22 of the frame structure 20, with one strip 42 being positioned on a mounting lip 74 and one strip 41 being positioned directly on the inner surface of the frame structure. Furthermore, in some embodiments, the one or more lights 40, such as the RGB-LEDs, can be addressable such that certain of the lights 40 emit one desired color while one or more other lights 40 are emitting different colors.

In some embodiments of the presently-disclosed color changing display system 10, the lights 40 comprise an addressable matrix of RGB-LEDs, where the color of each RGB-LED can be controlled independently. Exemplary RGB-LEDs that can be used to produce an addressable matrix of RGB-LEDs include RGB 3-W 10.6×10 mm SMT AstraLEDs (Lumex, Inc., Palatine, Ill.).

Figure 7:
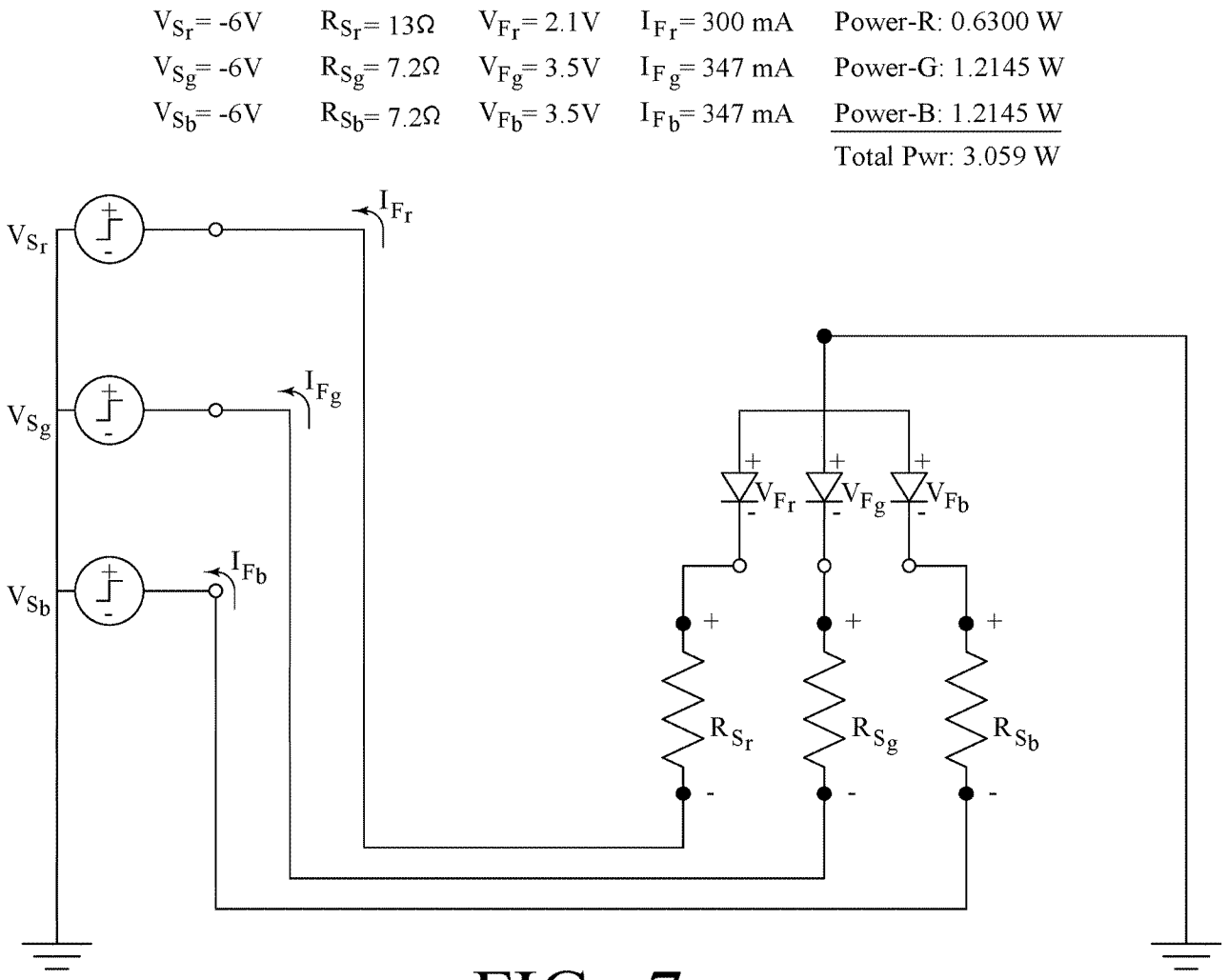
FIG. 7 is a circuit diagram for an addressable matrix of RGB-LEDs used in accordance with the present invention.

In constructing an addressable matrix of RGB-LEDs, a circuit is typically created, such as what is shown in FIG. 7, where each diode is placed in series with a source resistor ($R_S$) and is also connected to a voltage source ($V_S$). The voltage source provides a means of independently controlling the behavior of the individual LEDs, whereas the source resistors are used to limit the current that passes through the diodes, as LEDs are current-dependent devices. Values for the circuit component specifications used in an exemplary circuit are provided in FIG. 7.

Figure 17:
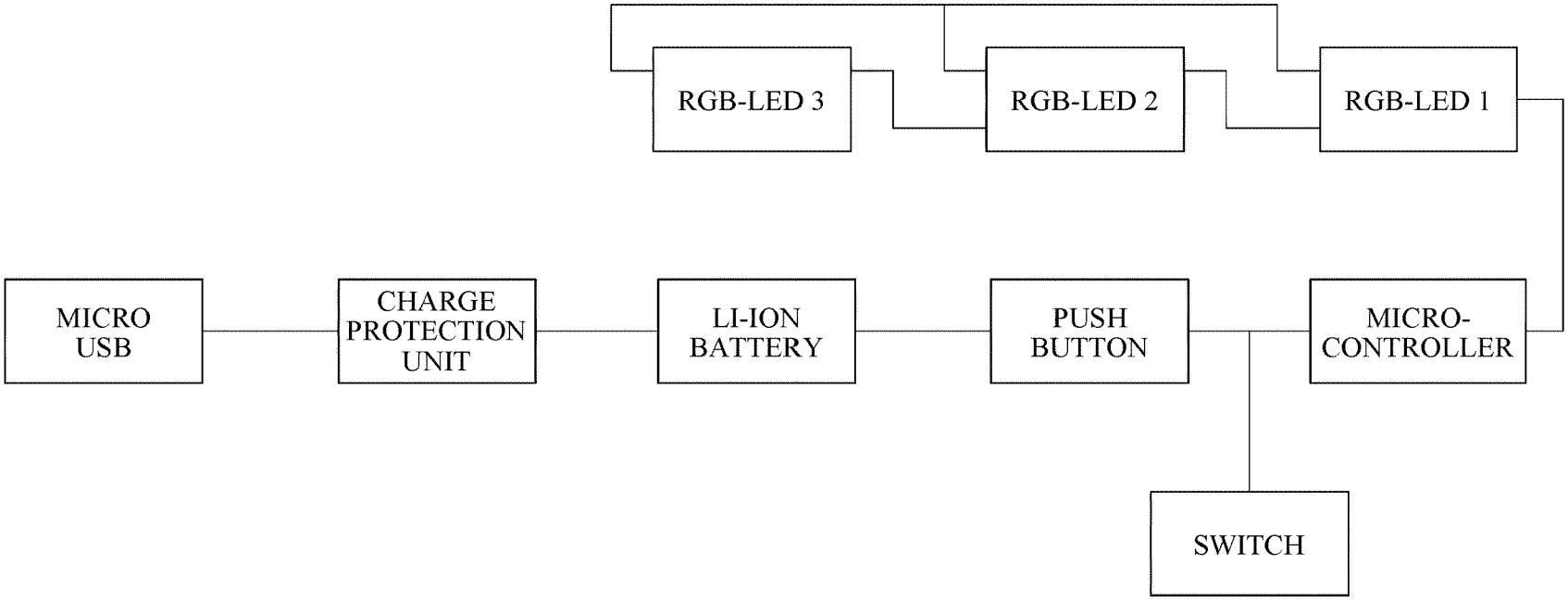
FIG. 17 is a circuit diagram for an addressable series of RGB-LEDs used in accordance with the present invention.

Referring now to FIG. 17, where the light source comprises one or more lights, a circuit is created where each RGB-LED is individually addressable and connected in series. Each RGB-LED contains both data in ports and data out ports such that data packets can be handed off between RGB-LEDs directly. The circuit is controlled by a microcontroller and includes a li-ion battery with a li-ion protection unit to prevent the battery from over and under charging. In some embodiments the li-ion protection circuit charges the battery to 4.2 v and stops operation when the battery is drained to an unsafe level, such as 3.2 v. The microcontroller sends packets containing, for example, color values ranging from 0-255 for each of the red, blue, and green colors, via PWM code to the first RGB-LED (RGB-LED1) containing one LED diode. The first RGB-LED (RGB-LED1) hands the color data packet to the next RGB-LED (RGB-LED2) via the data out ports and data in ports contained within the RGB-LEDs. This continues along for as many RGB-LEDs are connected in series (three shown in FIG. 17). The circuit further includes a push button to connect power from the li-ion battery to the microcontroller as well as a switch in communication with the controller to allow for the control of different modes, such as different colors or color shifting effects. The li-ion battery shown in FIG. 17 is charged by a micro-USB, but it is contemplated that any known power source could be used without departing from the spirit and scope of the present invention.

Although the light source 40 has been described herein with reference to RGB-LEDs, it is contemplated that the light source 40 can be comprised of numerous other types of lights that are capable of transmitting different colors of light and transitioning between those different colors. Exemplary types of additional lights that may be used in accordance with the presently-disclosed subject matter include, but are not limited to, flashlights, fixed-lights with color changing bulbs, and the like. Additionally, it is contemplated that the light source 40 of the color changing display system 10 can be positioned on various portions of the color changing display system 10 to provide a color changing display that is back-lit, front-lit, or both back-lit and front-lit.

The above-described color changing display, which incorporates one or more lights to produce a color changing illumination and change the appearance of a combined image, can advantageously be used to display various combined images and make those images appear to change and/or become animated as the lights directed toward those images transition between different colors of the spectrum. As such, the presently-disclosed color changing display can be used in a number of applications in the fine art, entertainment, and advertising industries as an energy-efficient alternative to known displays and advertisements.

For example, a color changing display can be incorporated into a table or bar top such that the combined image of the display serves as the surface of the table or bar. Additionally, it is contemplated that a color changing display can be combined with indium tin oxide to produce a touch screen that provides a user with an interactive color changing display. As another example, it is contemplated that the color changing displays can be used to produce billboards containing fully addressable matrices of RGB-LEDs. It is further contemplated that the color changing displays can be incorporated into automobiles and other vehicles with clear or slightly opaque body paneling so as to affix various logos onto the panels and then illuminate them such that the logos and images become animated.

It is also contemplated that the concepts described herein above can be used to produce various color changing clothing and apparel wherein lights within the clothing or apparel are used to animate a combined image on the clothing. In this regard, clothing or various fabric materials, onto which combined images are digitally printed or sub-dye laminated and in which various lighting products (e.g., Organic Light Emitting Diode (OLED) screens or Phillips Lumalive® lighting technology (Philips Electronics N.V. LLC, Eindhoven, Netherlands)) are installed and/or integrated into, behind, or between the fabrics, can be created in a manner whereby light is projected through the fabric and onto the combined image to create the desired effect. Of course, such a technique can also be applied to numerous other types of fabric products including, but not limited to, hats, blankets, curtains, and the like.

Additionally, it is contemplated that a backpack can be made out of a clear or opaque diffusing plastic material that is semi-rigid or rigid in structure and includes RGB-LEDs, such that the RGB-LEDs are used to project light onto a combined image on the backpack and produce an animation on the surface of the backpack. As will be recognized by those skilled in the art, such a backpack can be used to display advertising, but may also be used to promote the safety and security of children or in crowded situations or during travel.

Finally, it is contemplated that shoes with integrated RGB-LEDs can be fabricated such that the light from the RGB-LEDs is projected onto clear or diffusing soles of the shoes that include a combined image.

Further provided, in some embodiments of the presently-disclosed subject matter, is a color changing display system 110 that comprises: a body 150 in the form of a bottle 150 having a compartment 130 positioned in a lower portion of the bottle 150; a light source 140 secured within the compartment 130 for producing a color changing illumination; a removable label 154 being attached to the bottle 150 such that the label 154 surrounds at least a portion of the bottle 150; a combined image 160 comprising two or more images affixed to the label 154 such that an appearance of the combined image 160 changes in response to different colors of light; a controller 170 secured within the compartment 130 for controlling the light 140; and a power supply 172 secured within the compartment 130 and connected to the controller 170.

More specifically, the bottle 150 (body) is comprised of a light-transmitting material such that the different light colors projected from the light source 140 are transmitted through the light-transmitting material of the bottle 150. Furthermore, it is contemplated that the removable label 154 is configured for diffuse transmission of the different light colors such that the light transmitted through the bottle 150 is then transmitted evenly through the label 154 to back-light the combined image 160.

Figure 8:
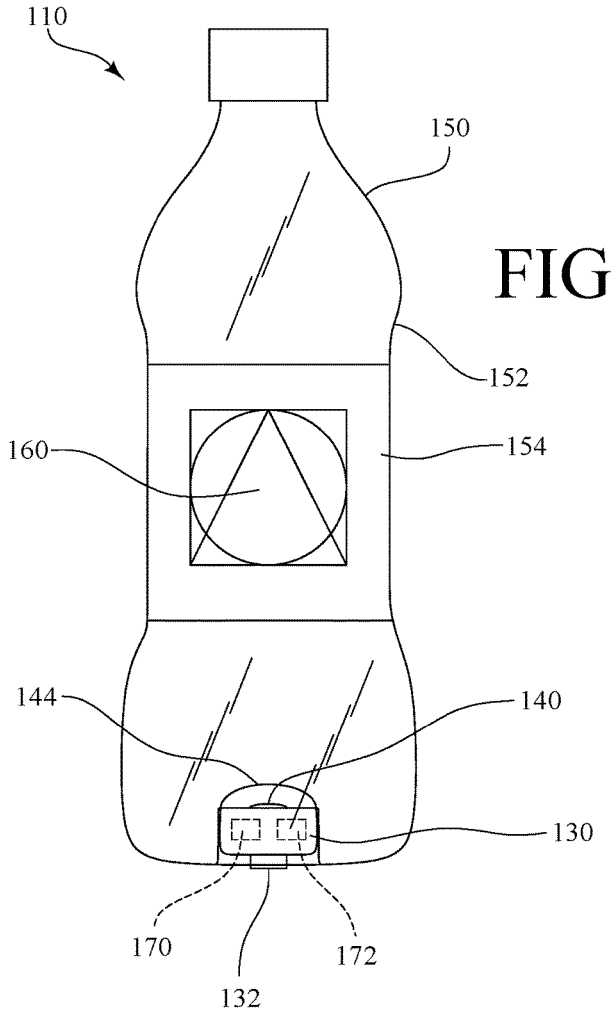
FIG. 8 is a front view of another exemplary embodiment of a color changing display system in accordance with the present invention where the body is a bottle.
Figure 9:
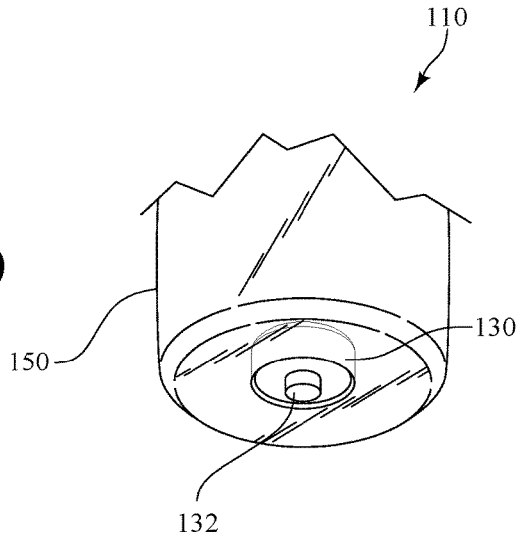
FIG. 9 is a bottom perspective view of a lower portion of the exemplary color changing display system of FIG. 8.

As shown in FIGS. 8 and 9, the color changing display system 110 includes a single RGB-LED as the light source 140 that is incorporated into the compartment 130 at the lower portion of the bottle 150 along with the controller 170 (e.g., a micro-controller), the power supply 172 (e.g., batteries), and a switch 132 electrically connected to the light source. A magnifier 144 is further installed above the bulb of the RGB-LED such that the light from the RGB-LED is projected through the magnifier and upward into the body of the bottle 150 to illuminate the contents of the bottle 150 and further illuminate the label 154 that includes the combined image 160. Once the light contacts the combined image 160, a multitude of seemingly holographic and/or animated images is then produced, as described herein above.

In some embodiments, an exemplary bottle used in the color changing display system can be molded from glass or plastic such that an internal magnifier and a compartment for the lights and their accompanying components is formed during the molding process. In such an embodiment, the light can be affixed upright in the bottle such that the light projects through the bottle itself, and the switch can be positioned on the bottom of the bottle to allow the lights to be easily turned on or off or set to perform a specific function (i.e., a program where different colors of lights are illuminated and fade in turn). In some embodiments, where the switch 132 is positioned on the bottom of the bottle, setting the bottle down on a surface operates the switch 132 and causes the light to turn on or off.

In yet further embodiments of an exemplary color changing bottle, the bottle can further include a molded or printed bottle cap that can be embossed or printed with a desired image. When the light in these bottles is turned on and projected throughout the bottle, the light can then penetrate through and project the cap image onto a surface. For example, when an exemplary bottle is placed on a table and the light is turned on, the logo can be projected on a ceiling above the bottle.

A color changing vending machine may comprise a vending machine having a light-transmitting display surface; one or more lights secured in an interior portion of the vending machine for producing a color changing illumination; a combined image comprising two or more images affixed to the light-transmitting display surface such that the appearance of the combined image changes in response to different colors of lights; a controller for controlling the one or more lights; and a power supply connected to the controller.

To construct an exemplary color changing vending machine in accordance with the presently-disclosed subject matter, a vending machine, such as a standard beverage vending machine, can first be obtained and the front display of the machine can be removed to allow the lighting inside of the machine to then be removed as well. Then, one or more strips of RGB-LEDs can be installed around the edges of the display front, or otherwise mounted inside the display, and angled slightly toward the front of the machine (similar to the lights of the color changing display described herein above) such that the lights will shine directly upon the front of the display and animate a combined image that is affixed to the display in place of the standard vending machine or beverage company logo or promotional image. Of course, a controller and power supply for the lights can readily be included in such a machine and adapted for use with a wide variety of lighting options that can be used in place of the RGB-LEDs. Additionally, the lights included in an exemplary vending machine can also be arranged in a matrix (e.g., a matrix of RGB-LEDs) such that each light is addressable and the color of each light can be controlled independently within each vending machine. Furthermore, it is contemplated that color changing lights can be integrated into the machine in other locations, such as behind the buttons or around the beverage dispensing area, and used with a combined image to create an aesthetically pleasing animated effect on other areas of the vending machine.

Figure 10:
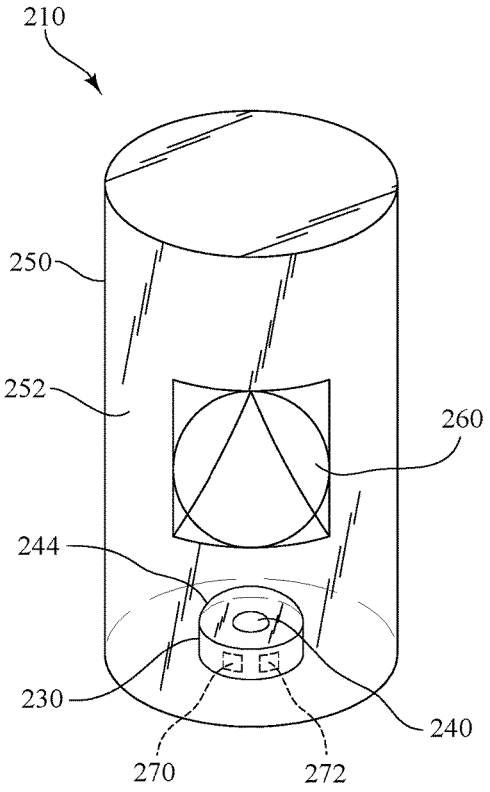
FIG. 10 is a perspective view of another exemplary embodiment of a color changing display system in accordance with the present invention.

Referring now to FIG. 10, in another exemplary embodiment of the present invention, a color changing display system 210 comprises a light source 240 for producing different light colors, a controller 270 electrically connected to the light source for controlling the light source to provide a smooth transition between the different light colors, and a body 250 with a combined image 260 comprising two or more images printed in a single layer and positioned on the body 250. As described above with reference to FIGS. 3A-3D, the two or more images (i.e., a red triangle, a green circle, and a blue square) forming the combined image 260 are difference colors with each of the different color images reacting with a respective color of the different light color such that an appearance of the combined image changes gradually from a first display image having one particular shape into a second display having a second particular shape in response to the different light colors interacting with the combined image to produce a moving, seemingly holographic effect.

As shown in FIG. 10, the body 250 defines a compartment 230 in a lower portion of the body 250 with the light source 240 and controller 270 positioned within the compartment 230 of the body 250. Furthermore, the combined image 260 is affixed to an exterior surface 252 of the body 250. As such, the body 250 of the exemplary color changing display system 210 is comprised of a light-transmitting material such that the light source 240 projects the different light colors onto the body (i.e., onto a surface of the compartment 230) such that the different light colors are transmitted through the light-transmitting material of the body 250 and the combined image 260 is back-lit. To this end, the exemplary color changing display system 210 shown in FIG. 10 further includes a magnifier 244 positioned adjacent to the light source 240 for focusing the different light colors towards the combined image 260, the magnifier 244 being substantially similar to the magnifier 144 described above with reference to FIG. 8.

Further included in the compartment 230 of the exemplary color changing display system 210 shown in FIG. 10, is a power source 272 electrically connected to the light source 240 and the controller 270 such that the controller 270 controls the amount of power supplied to the light source 240 from the power source 272. In this way, the color changing display system 210 shown in FIG. 10 is a substantially self-contained unit, which in some embodiments is sized for portability.

Figure 11:
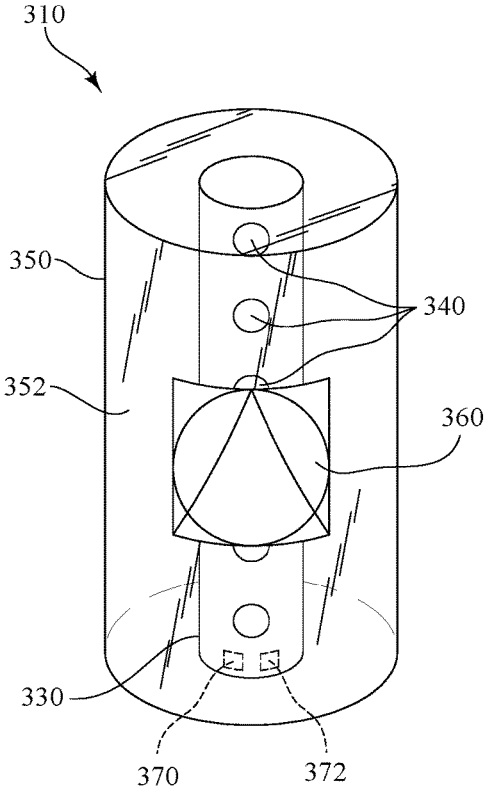
FIG. 11 is a perspective view of another exemplary embodiment of a color changing display system in accordance with the present invention.

Referring now to FIG. 11, another exemplary color changing display system 310 of the present invention is substantially similar to the color changing display system 210 described above with reference to FIG. 10, but with the compartment 330 of the color changing display system 310 shown in FIG. 11 running through substantially the entire length of the body 350 and including a plurality of lights along the length of the body 350 which collectively act as the light source 340. In particular, the color changing display system 310 shown in FIG. 11 includes a light source 340 (i.e., a plurality of lights), a controller 370, and a power source 372 all positioned within the elongated compartment 330 defined by the body 350 and a combined image 360 is positioned on the exterior surface 352 of the body 350. It is contemplated that by providing a plurality of lights located in different positions within the body 350, the combined image 360 can be more evenly back-lit. As such, although the combined image 360 in FIG. 11 is shown only covering a small portion of the exterior surface 352 of the body 350, it is contemplated that the combined image 360 may be sized to cover substantially all of the exterior surface 352 of the body 350, including in some embodiments the top and/or bottom surfaces.

Figure 12:
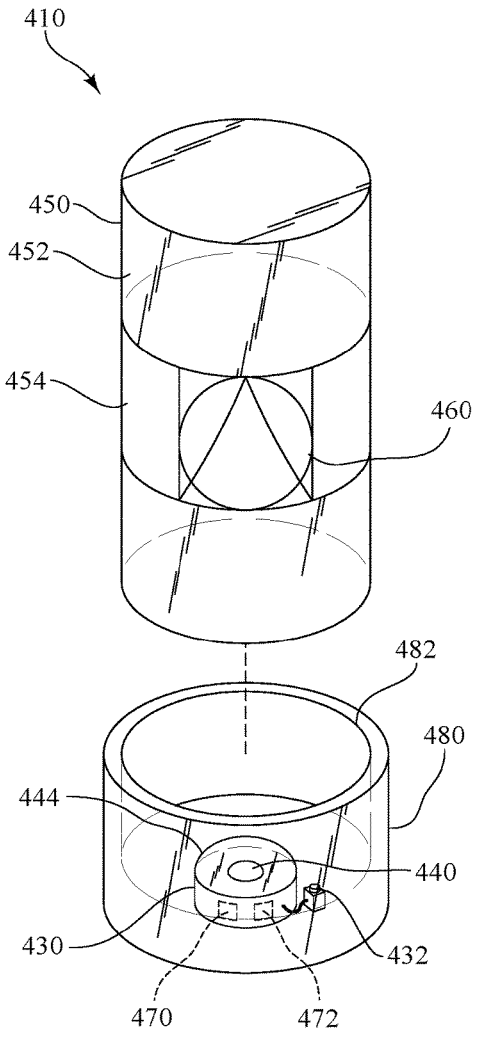
FIG. 12 is a perspective view of another exemplary embodiment of a color changing display system in accordance with the present invention, with a body shown removed from a docking member.

Referring now to FIG. 12, another exemplary color changing display system 410 comprises a docking member 480 defining a cavity 482, a light source 440 secured to the docking member 480, and a body 450 removably connected to the docking member 480 with a combined image 460 positioned on an exterior surface 452 the body 450. In particular, the body 450 and docking member 480 are configured such that the body 450 is partially contained within the cavity 482 of the docking member 480 is connected to the docking member 480, but the combined image 460 will still be at least partially visible.

The docking member 480 also defines a compartment 430 which houses the light source 440, a controller 470, and a power source 472 substantially similar the color changing display systems described above but located in the docking member 480 rather than the removable body 450. The color changing display system 410 further comprises a switch 432 electrically connected to the light source 440 such that when the body 450 is connected to the docking member 480, the switch 432 is activated. As shown in FIG. 12, the switch 432 can be positioned within the cavity 482 of the docking member 480 such that the body 450 contacts the switch 432 when inserted into the cavity 482 of the docking member 480, however other locations of the switch 432 are also contemplated. For example, in some embodiments the switch is located on a side surface of the cavity of the docking member, or any other location on either the docking member, the body, or some other object.

Regardless of the location of the switch 432, it is contemplated that when the switch 432 is activated, the light source 440 secured to the docking member 480 produces different light colors which are projected onto the body 450 (i.e., a bottom surface of the body 450) such that the different light colors are transmitted through the light-transmitting material of the body 450 and the combined image 460 is back-lit, in substantially the same manner as described above with reference to the color changing displays system 210 shown in FIG. 10. In particular, the color changing display system 410 in FIG. 12 also includes a magnifier 444 positioned in the docking member 480 adjacent to the light source 440 for focusing the different light colors towards the combined image 460 on the body 450.

The color changing display system 410 in FIG. 12 further includes a portion 454 of the light-transmitting material of the body 450 which is configured for diffuse transmission of the different light colors and the combined image 460 is positioned atop the portion 454 configured for diffuse transmission. In this way, the different light colors transmitted through the light-transmitting material of the body 450 are then transmitted evenly through the portion 454 configured for diffuse transmission to evenly back-light the combined image 460. It is contemplated that the portion 454 configured for diffuse transmission can be the majority of the body 450, a discrete section of the body 450, or a thin layer of material adjacent to the exterior surface of the body 450, such as a film, substrate, or removable label.

Figure 13:
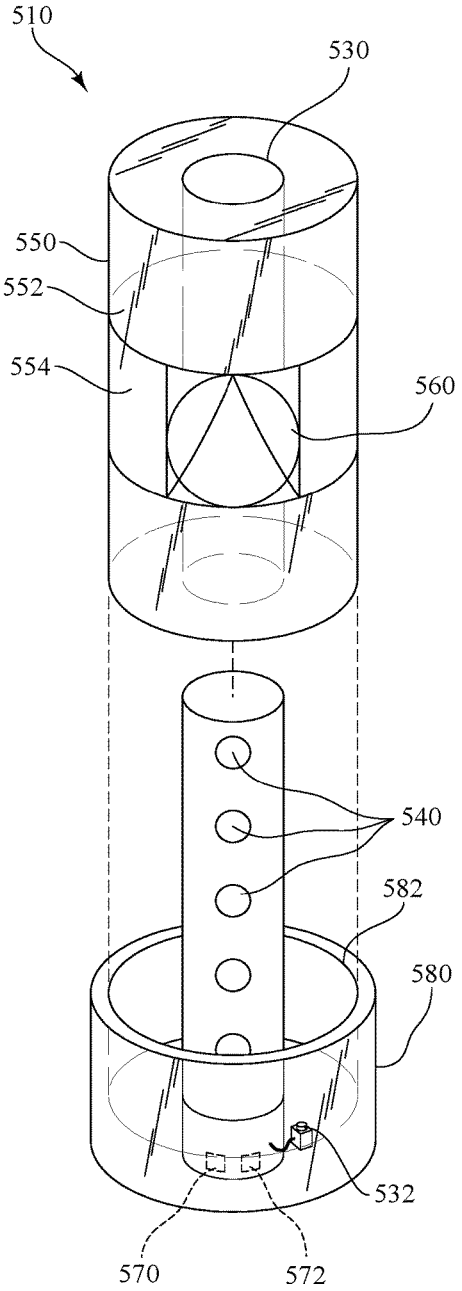
FIG. 13 is a perspective view of another exemplary embodiment of a color changing display system in accordance with the present invention with a body shown removed from a docking member.

Referring now to FIG. 13, another exemplary color changing display system 510 of the present invention is substantially similar to the color changing display system 410 described above with reference to FIG. 12, but with the light source 540 (i.e. a plurality of lights which collectively act as the light source 540) secured to and extending upward from the docking member 580 and with the removable body 550 further defining a compartment 530 running through substantially the entire length of the body 550 such that when the body 550 is connected to the docking member 580 (i.e., partially contained within the cavity 582 of the docking member 580), the light source 540 is positioned within the compartment 530 of the body 550. As such, it is contemplated that the combined image 560 positioned on the exterior surface 552 of the body 550 is more evenly back-lit. Furthermore, like the color changing display system 410 described above with reference to FIG. 12, the body 550 also includes a portion 554 of the light-transmitting material of the body 550 which is configured for diffuse transmission of the different light colors and the combined image 560 is positioned atop the portion 554 configured for diffuse transmission.

The color changing display system 510 of FIG. 13 also includes a controller 570, power supply 572, and switch 532 all positioned on, or within the docking member 580 substantially similar to the color changing display system 410 described above with reference to FIG. 12.

Although the bodies 250, 350, 450, 550 shown in FIGS. 10-13 are substantially cylindrical, one skilled in the art would recognize that the body can also be in any arbitrary shape or size depending on the particular intended use of the color changing display. Similarly, although the light sources are shown in either the bottom portion or central portion of the body, one skilled in the art would recognize that the light source may be positioned anywhere in, on, or adjacent to the body so long as the different light colors are able to transmit through the body to back-light the combined image and allow the different color images of the combined image to react with a respective color of the different light colors. For example, in some embodiments, the body is a long extended body aligned vertically, such as a pillar, column, or post. In other embodiments, the body is substantially flat on at least one side to function as a sign or billboard. In yet other embodiments a plurality of bodies are integrated into a larger structure, such as a truss system. In other embodiments still, the body is part of some other functional object such as a lighter or poi balls.

In some embodiments, particularly where strength is a factor, the body is a substantially solid object made of a light-transmitting material so that the different light colors transmit substantially unobstructed through the light-transmitting material of the body. Alternatively, the body is substantially hollow with a large internal cavity. In such an embodiment, the light is transmitted around the internal cavity by the body itself, or through the inclusion of other well-known means, such as fiber optic cables. In another embodiment, the light source is positioned and configured such that the different light colors are transmitting through the internal cavity itself instead of or in addition to also transmitting around the internal cavity. Further still, in another embodiment such an internal cavity is filled with another medium having light-transmitting properties, such as a fluid.

Figure 16:
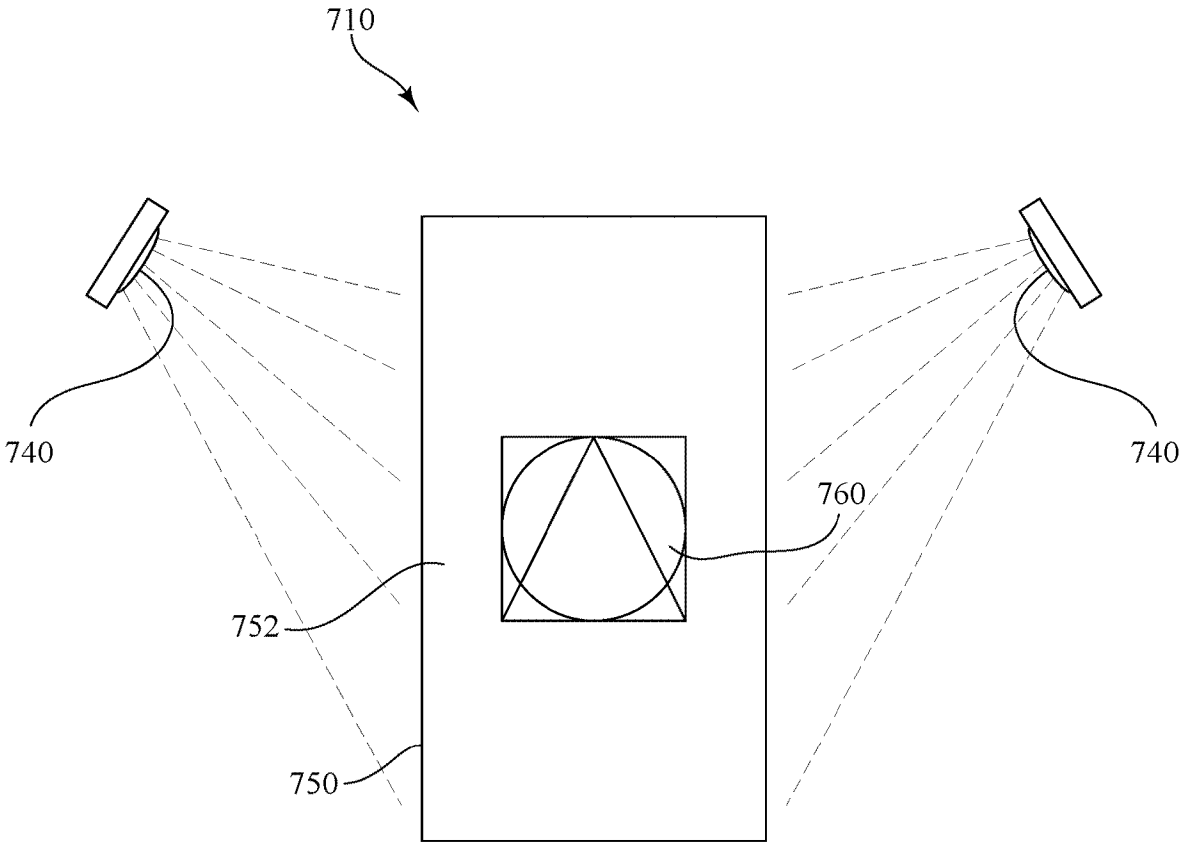
FIG. 16 is a schematic representation of another embodiment of a color changing display system in accordance with the present invention.

In another embodiment, the different light colors are not transmitted through the body at all, but instead are projected directly onto the combined image such that the combined image is front-lit. Referring now to FIG. 16, in another exemplary embodiment of a color changing display system 710 of the present invention, the light source 740 (here shown as two separate lights) is independent of the body 750 and positioned a distance away from the body 750 such that the light source 740 projects the different light colors onto an exterior surface 752 of the body 750 and the combined image 760 positioned on the exterior surface 752 is front-lit. In such an embodiment, the body 750 does not need to be comprised of a light-transmitting material as the combined image 760 can be fully illuminated without requiring the different light colors to be transmitted through the body 750. Of course, the combined image could be simultaneously front-lit and back-lit, in which case the body may still comprise a light-transmitting material. Once again although the body 750 is shown in FIG. 16 as a rectangle, one skilled in the art would recognize that the body can also be in any arbitrary shape or size so long as when the light source projects the different light colors onto the body, the different light colors are front-light the combined image and allow the different color images of the combined image to react with a respective color of the different light colors. A list of non-limiting examples include public structures (e.g. a sign, pillar, or building), a small portable item (e.g., a pen, lighter, or jewelry), or fabrics such as may be included in a shirt, hat, backpack, or shoe. Furthermore, the body may include multiple portions which when viewed collectively display all or part of the combined image.

Figure 14:
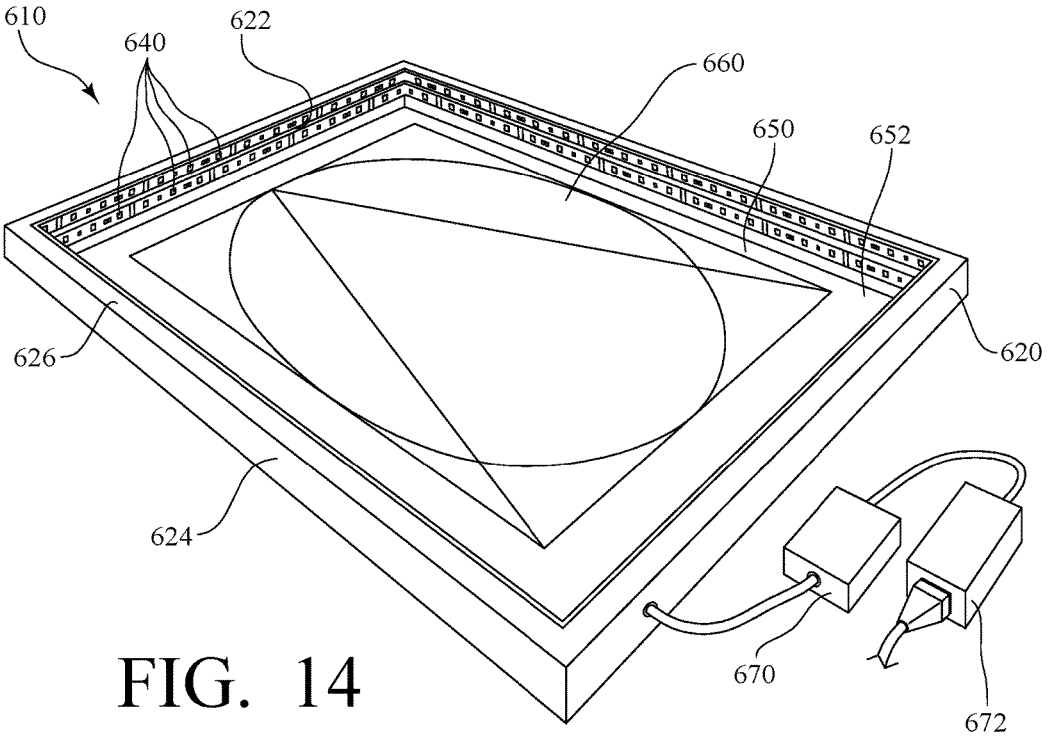
FIG. 14 is a perspective view of another exemplary embodiment of a color changing display system in accordance with the present invention, but without a front panel affixed to a front edge of the frame structure.
Figure 15:
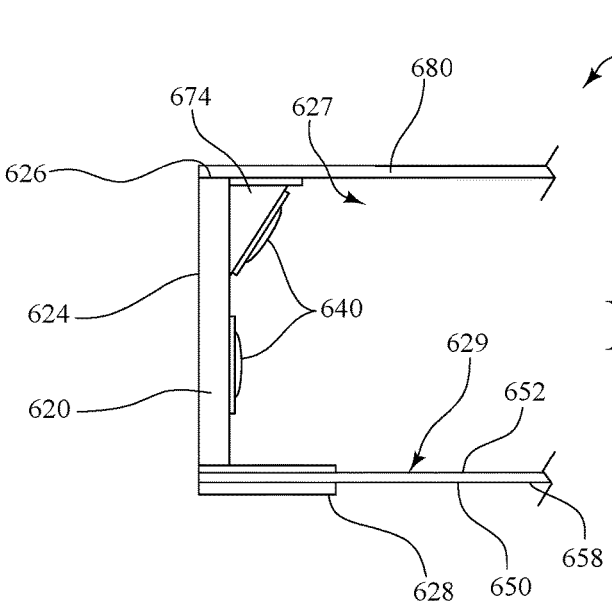
FIG. 15 is a partial cross-sectional view of the color changing display system of FIG. 14, illustrating lights secured to a mounting lip and inner surface of the frame structure.

Referring now to FIGS. 14-15, in one particular embodiment, an exemplary color changing display system 610 comprises a frame structure 620 having an inner surface 622, an outer surface 624, a front edge 626 defining an open front portion 627 of the frame structure 620, and a back edge 628 defining an open back portion 629 of the frame structure. In the color changing display system 610 of FIGS. 14-15, the body 650 is in the form of a panel 650 having a front surface 652 and a back surface 658. The panel 650 is attached to the back edge 628 of the frame structure 620 such that the panel 650 covers the open back portion 629 of the frame structure 620 with the front surface 652 of the panel 650 facing towards the open front portion 627 of the frame structure 620. The combined image 660 is affixed to the front surface 652 of the panel 650 and is therefore front-lit by the light source 640 (i.e., one or more lights) secured to the frame structure 620. Similar to the color changing display system 10 shown in FIGS. 1 and 2, in the color changing display system 610 shown in FIGS. 14-15 a mounting lip 674 is secured around the inner surface 622 of the frame structure 620 near the open front portion 627 of the frame structure 620 such that the mounting lip 674 secures the one or more lights 640 at a desired angle relative to the panel 650 to appropriately front-light the combined image 660.

As shown in FIG. 15, a front panel 680 is also attached to the front edge 626 of the frame structure 620 such that the front panel 680 covers the open front portion 627 of the frame structure 620. The front panel 680 is made of glass, plexiglass, or a like material that will protect the panel 650 while still allowing it to be viewed through the front panel 680. The color changing display system 610 further includes a controller 670 and power source 672 electrically connected to the light source 640.

Although all of the color changing display systems described above include a light source for producing different light colors, in other embodiments a color changing display is provided which comprises just a body with a combined image positioned on the body without any lights associated with the body. The combined image of the color changing display comprises two or more images printed in a single layer wherein each of the different color images reacts with a respective different light color, such that an appearance of the combined image changes from a first display image into a second display image in response to the different light colors interacting with the combined image. Furthermore, the body of the color changing display, in some embodiments, comprises a light-transmitting material such that the body is configured to allow the different light colors to transmit through the light-transmitting material of the body and such that the combined image is back lit. In this way, as the color changing display does not include a light source itself, it may be transported between light sources which transmit different light colors onto, or through, the body of the color changing display. As an illustrative example, the body 450 with the combined image 460 shown in FIG. 12, in one such color changing display, is transported between a variety of docking units having a means of producing different light colors. Upon connecting the body 450 to one of the variety of docking units, the different color images of the combined image 460 react with a respective different light color produced by the docking unit, such that an appearance of the combined image 460 changes from a first display image into a second display image in response to the different light colors interacting with the combined image 460.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A color changing display system, comprising:

a docking member;

a light source secured to the docking member, the light source for producing different light colors;

a controller electrically connected to the light source, the controller configured to control the light source to provide a smooth transition between the different light colors;

a body removably connected to the docking member; and a combined printed image comprising two or more images printed in a single layer on the body, the images being different colors, each of the different color images reacting with a respective color of the different light colors such that an appearance of the combined printed image changes gradually from a first display image having one particular shape into a second display image having a second particular shape in response to the different light colors interacting with the combined printed image to produce a moving, seemingly holographic effect.

2. The color changing display system of claim 1, further comprising a switch electrically connected to the light source;

wherein when the body is connected to the docking member, the switch is activated.

3. The color changing display system of claim 1, wherein the docking member defines a cavity; and wherein the body is partially contained within the cavity when the body is connected to the docking member.

4. The color changing display system of claim 3, further comprising a switch positioned within the cavity of the docking member, the switch electrically connected to the light source;

wherein when the body is connected to the docking member, the switch is activated.

5. The color changing display system of claim 1, wherein the combined printed image is printed on an exterior surface of the body.

6. The color changing display system of claim 1, wherein the body comprises a light-transmitting material; and wherein the light source projects the different light colors onto the body such that the different light colors are transmitted through the light-transmitting material of the body and the combined printed image is back-lit.

7. The color changing display system of claim 6, wherein a portion of the light-transmitting material of the body is configured for diffuse transmission of the different light colors; and wherein the combined printed image is printed atop the portion of the light-transmitting material of the body configured for diffuse transmission, such that the different light colors are transmitted evenly through the portion of the light-transmitting material configured for diffuse transmission to evenly back-light the combined printed image.

8. The color changing display system of claim 1, wherein the body is a bottle.

9. The color changing display system of claim 8, wherein the bottle further comprises a removable label configured for diffuse transmission of the different light colors; and wherein the combined printed image is printed on the label, such that the light source projects the different light colors through the bottle and the different light colors are transmitted evenly through the label to evenly back-light the combined printed image.

10. The color changing display system of claim 8, wherein the bottle comprises a light-transmitting material; and wherein the light source projects the different light colors onto the bottle such that the different light colors are transmitted through the light-transmitting material of the bottle and the combined printed image is back-lit.

11. The color changing display system of claim 8, wherein the bottle is at least partially filled with a light-transmitting fluid; and wherein the light source projects the different light colors onto the bottle such that the different light colors are transmitted through the light-transmitting fluid in the bottle and the combined printed image is back-lit.

12. The color changing display system of claim 1, wherein the body defines a compartment and the light source extends away from the docking member such that, when the body is connected to the docking member, the light source is positioned within the compartment of the body.

13. A color changing display system, comprising:

a docking member;

a light source secured to the docking member, the light source for producing different light colors;

a controller electrically connected to the light source, the controller configured to control the light source to provide a smooth transition between the different light colors;

a bottle removably connected to the docking member, the bottle including a removable label; and a combined printed image comprising two or more images printed in a single layer on the label of the bottle, the images being different colors, each of the different color images reacting with a respective color of the different light colors such that an appearance of the combined printed image changes gradually from a first display image having one particular shape into a second display image having a second particular shape in response to the different light colors interacting with the combined printed image to produce a moving, seemingly holographic effect.

14. The color changing display system of claim 13, further comprising a switch electrically connected to the light source; and wherein when the bottle is connected to the docking member, the switch is activated.

15. The color changing display system of claim 13, wherein the docking member defines a cavity; and wherein the bottle is partially contained within the cavity when the bottle is connected to the docking member.

* * * * *